US010364560B2

(12) United States Patent
Hornstein et al.

(10) Patent No.: US 10,364,560 B2
(45) Date of Patent: Jul. 30, 2019

(54) TRAP WATER REMOVAL APPARATUS AND METHOD OF USE

(71) Applicant: Platypus Tools Inc., Calgary, Alberta (CA)

(72) Inventors: David Hornstein, Calgary (CA); Micah Libin, Calgary (CA)

(73) Assignee: Platypus Tools Inc. (CA)

( * ) Notice: Subject to any disclaimer, the term of this patent is extended or adjusted under 35 U.S.C. 154(b) by 221 days.

(21) Appl. No.: 14/620,983

(22) Filed: Feb. 12, 2015

(65) Prior Publication Data

US 2015/0322653 A1 Nov. 12, 2015

Related U.S. Application Data

(60) Provisional application No. 61/938,928, filed on Feb. 12, 2014.

(51) Int. Cl.

| | |
|---|---|
| ***E03C 1/30*** | (2006.01) |
| ***E03C 1/12*** | (2006.01) |
| ***E03D 9/00*** | (2006.01) |

(52) U.S. Cl.

CPC ..... *E03C 1/30* (2013.01); *E03C 1/12* (2013.01); *E03D 9/00* (2013.01)

(58) Field of Classification Search

CPC ..... E03C 1/30; E03C 1/12; E03D 9/00
USPC ..... 4/255.01, 255.02
See application file for complete search history.

(56) References Cited

U.S. PATENT DOCUMENTS

| | | | | |
|---|---|---|---|---|
| 2,311,197 | A * | 2/1943 | Ahern | E03C 1/308 134/24 |
| 2,697,842 | A * | 12/1954 | Meyer | E03D 9/00 4/255.01 |
| 5,927,957 | A * | 7/1999 | Kennedy | E03C 1/308 4/255.02 |
| 5,940,897 | A * | 8/1999 | James | E03C 1/308 4/255.02 |
| 8,359,679 | B2 | 1/2013 | Martin | |
| 8,418,275 | B1 | 4/2013 | Dondurur et al. | |
| 2003/0088909 | A1* | 5/2003 | Ollinger | E03D 9/00 4/255.02 |
| 2004/0111792 | A1* | 6/2004 | Shaltiel | F16L 55/128 4/255.01 |
| 2005/0229296 | A1 | 10/2005 | Lainer | |
| 2007/0017576 | A1 | 1/2007 | McHinnis et al. | |
| 2010/0138986 | A1 | 6/2010 | Abney | |
| 2012/0031430 | A1 | 2/2012 | Thykjaer | |
| 2012/0247519 | A1 | 10/2012 | Dondurur | |
| 2013/0048116 | A1 | 2/2013 | Foster | |

* cited by examiner

*Primary Examiner* — Huyen D Le
(74) *Attorney, Agent, or Firm* — Burns & Levinson, LLP; Joseph M. Maraia

(57) ABSTRACT

A device and method of using a device for removing water from the trap of a plumbing appliance. In one embodiment, the apparatus provides a housing within which is movably mounted a plunger. An elongate hose is provided at one end of the housing to receive trap water therein upon actuation of the plunger or an inflatable member is provided at one end of the housing to force the trap water by inflating same by actuation of plunger. The disclosure also relates to methods of removing trap water using the apparatus described herein.

10 Claims, 4 Drawing Sheets

TRAP WATER REMOVAL APPARATUS AND METHOD OF USE

CROSS-REFERENCE TO RELATED APPLICATION(S)

This application claims the benefit of priority of U.S. Provisional Patent Application No. 61/938,928 filed on Feb. 12, 2014, entitled "Trap Water Removal Apparatus and Method of Use," the entirety of which is hereby incorporated by reference.

TECHNICAL FIELD

The present disclosure relates to a device and method for removing trap water from a plumbing fixture in an efficient manner.

BACKGROUND

It is well established that one of the problems when removing and/or replacing a plumbing device such as toilet seat is the water in the trap way. Common methods for dealing with this water are deliberately spilling it in a bath or shower or using sponges or a vacuum. This is obviously unsanitary and inconvenient, as well as increases the time of a service call which is not productive for the tradesman. Further, the water can be spilled on the floor or on the tradesman when the toilet is being removed which is clearly unsanitary. The added weight with the presence of the water also presents a challenge for lifting.

Plungers and similar articles have been developed. However, there does not appear to be recognition of an arrangement suited for this purpose. Examples include U.S. Patent Publication No. US2012/0031430, published Feb. 9, 2012, for a cleaning device and cleaning method. In the publication, the disclosure teaches a cleaning device having an expandable member which is adapted to be inserted in the S shaped bend of the toilet. There is no contemplation for use of the arrangement to remove water from the outlet. This is evinced by the fact that no provision from an apparatus point of view was made to transfer water from the tank to the bowl. Accordingly, the publication is primarily focused on a cleaning arrangement.

In U.S. Patent Publication No. US2010/0138986, published Jun. 10, 2010, an inflatable toilet bowl drain plumbing device is disclosed. Premise of the publication is directed to a cleaning system. The specification outlines a procedure for providing an effective methodology for cleaning the plumbing appliance. In this disclosure, the inflatable bladder is primarily used as a blocking device so a liquid cleaning solution can be introduced into the bowl for retention purposes without dissipating which would be the case absent the blockage member. After a sufficient period the inflated bladder is deflated and the toilet bowl filled to an auto-flush level at which point the inflatable bladder is removed from the drain.

In U.S. Patent Publication No. US2007/0017576, published Jan. 25, 2007, an inflating arrangement is disclosed in this arrangement the device is permanently installed an includes a blocking member. Similar to the previously discussed reference, no contemplation has been made in respect of removing water from a outlet of the plumbing appliance. The arrangement is simply directed to a plug to prevent reflux of sewage.

Other solutions to the trap water problem that have been proposed include gelling compounds which form a gel once contacted with the tap water to avoid spillage.

Apart from the references that have been set forth herein previously, there are a host of other references which are specifically designed for clog removal including, U.S. Pat. Nos. 8,359,679; 8,418,275, as well as further publications, namely: U.S. Patent Publication Nos. US2012/0247519; US2005/0229296; and US2013/0048116 inter alia.

This background information is provided to reveal information believed by the applicant to be of possible relevance to the present disclosure. No admission is necessarily intended, nor should be construed, that any of the preceding information constitutes prior art against the present disclosure.

SUMMARY

An object of the present disclosure is to provide an improved device and method of use for removing trap water from a plumbing device/appliance.

In accordance with an aspect of the present disclosure there is provided, an apparatus for removing water from a plumbing device drain trap, comprising: a housing comprising side walls defining an elongated reservoir, and having a first opening and a second opening; a plunger assembly movably disposed within said housing through the first opening, said assembly comprising a rod having a plunger member at a first end and a handle portion at a second end, said plunger member configured to sealingly engage the sidewalls of the housing; and a hose coupled to the second opening of the housing in fluid communication with the reservoir, the hose including an open end for insertion into the plumbing device drain trap, the hose being adapted for moving water from the drain trap to the reservoir under suction imposed by operation of the plunger assembly.

In accordance with another aspect of the disclosure, there is provided a method for removing water from the trap of a plumbing device, comprising the steps of: a) providing an apparatus for removing water from said trap, wherein the apparatus comprises a housing comprising side walls defining an elongated reservoir, and having aa first opening and a second opening, a plunger assembly having a plunger member sealingly engaged with sidewalls of the elongate reservoir and movable within the elongate reservoir, and a hose coupled to the second opening of the housing in fluid communication with the reservoir, and including an open end; positioning the hose open end into the trap of the plumbing device; b) actuating said plunger member to draw water from said trap; c) temporarily retaining said water within said reservoir prior to disposal of said water in a location other than said trap; d) repositioning the hose open end for fluid communication with the location other than said trap; and e) actuating said plunger assembly to expel said water from said reservoir through the hose open end.

In one embodiment, the location other than said trap is a further portion of a drain of the plumbing device, the further portion of the drain being downstream of the drain trap.

In accordance with another aspect of the disclosure, there is provided an apparatus for removing water from a plumbing device drain trap, comprising: a housing comprising side walls defining an elongated reservoir, and having a first opening and a second opening opposite the first opening; a plunger assembly movably disposed within said housing through the first opening, said assembly comprising a rod having a plunger member at a first end and a handle portion at a second end, said plunger member configured to sealingly engage the sidewalls of the housing; an inflatable member connected to the second opening of said housing and inflatable by movement of said plunger assembly within said housing, said inflatable member for positioning into the outlet of said plumbing device.

In accordance with another aspect of the disclosure, there is provided a method for removing water from the trap of a plumbing device, comprising the steps of: a) providing an apparatus for removing water from said trap, wherein said apparatus includes a housing side walls defining an elongated reservoir, a first opening and a second opening, a plunger assembly having a plunger member sealingly engaged with sidewalls of the housing and movable within the elongate reservoir; and an inflatable member coupled to the second opening of the housing in fluid communication with the reservoir, and adapted to be inflated using said plunger; b) positioning said inflatable member into the outlet adjacent the trap of the plumbing device; c) inflating said inflatable member within said outlet to forcibly drive water contained in said outlet through said trap under the increasing pressure of the inflated inflatable member; and d) deflating said inflatable member for removal from within said outlet.

In accordance with another aspect of the disclosure, there is provided a kit for removing water from a plumbing device, comprising the one or more of the apparatus as defined above, and instructions for use of the apparatus.

BRIEF DESCRIPTION OF THE DRAWINGS

Similar numerals employed in the figures denote similar elements.

DETAILED DESCRIPTION

Figure 1:
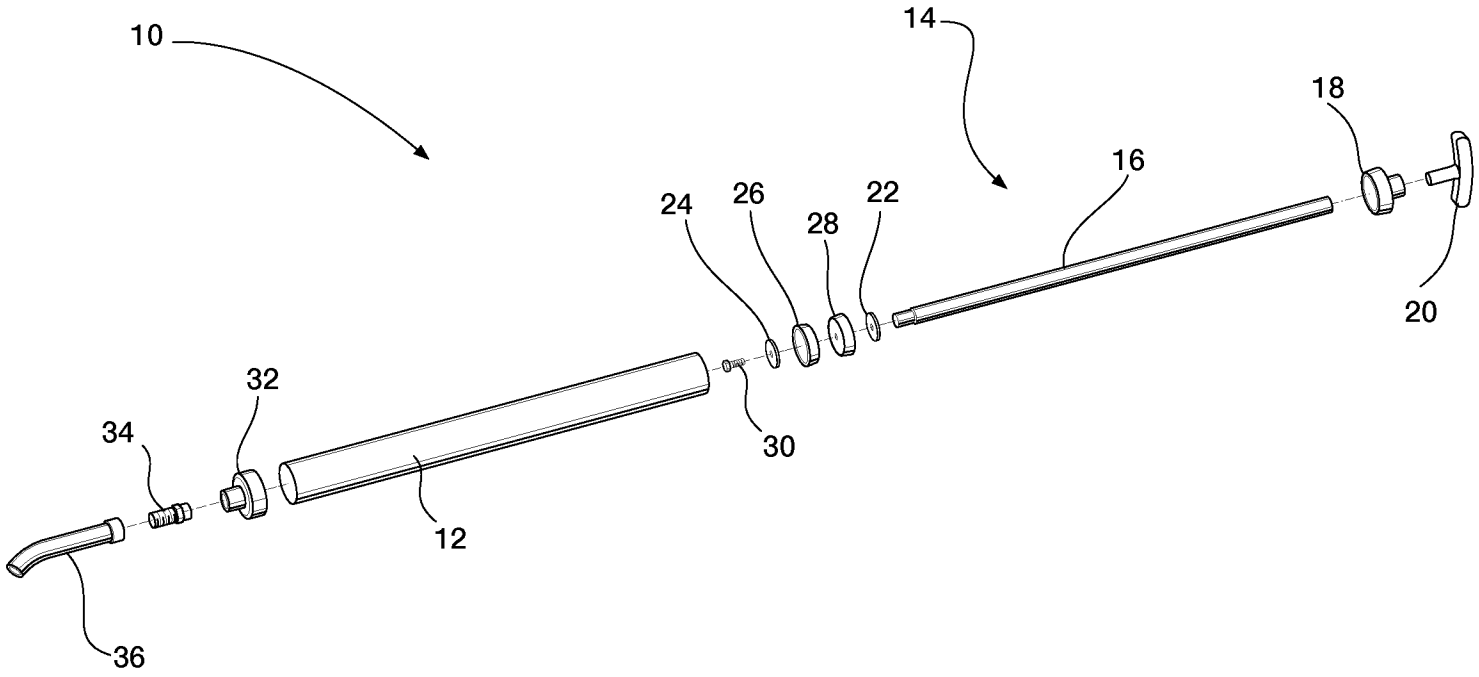
FIG. 1 is an exploded view of one embodiment of the present disclosure.

The present disclosure relates to an apparatus and a method of using same for removing a trap water from a plumbing device.

In one embodiment of the present disclosure, the apparatus for removing water from a plumbing device drain trap comprises a housing having a first and a second opening, and defining elongated water retaining reservoir adapted to retain water, a plunger assembly movably disposed therein through the first openings, and a hose member connected to the second opening of the housing in fluid communication with the reservoir of the housing, and having an open end for insertion into the plumbing device drain trap. The hose is adapted for moving water from the drain trap to the reservoir by operation of the plunger assembly.

In one embodiment, the apparatus for removing water from a plumbing device drain trap, comprises a housing; a plunger assembly movably mounted within the housing, an inflatable member connected to or positioned at the outlet of the plumbing device and inflatable by movement of the plunger assembly.

One embodiment of the present involves a method for removing water from the trap of a plumbing device/appliance, utilizing one of the apparatus as described above.

In one embodiment, the method for removing water from the trap of a plumbing device/appliance, comprises the steps of: providing an apparatus which includes a housing defining an elongated water retaining reservoir adapted to retain water, a plunger movably mounted therein and hose member connected to/positioned at the outlet of the reservoir and having an open; positioning the hose into the outlet adjacent the trap of the plumbing device; actuating the plunger to draw water from the trap; retaining the water within the hose and/or the reservoir; disposing of the water; and removing the appliance from the plumbing device.

In one embodiment of the present disclosure, the method for removing water from the trap of a plumbing device, comprises the steps of: providing a device for removing water, which includes a housing, a plunger assembly movably mounted therein and an inflatable member adapted to be inflated using the plunger assembly; positioning the inflatable member into the outlet adjacent the trap of the plumbing device; inflating said inflatable member within said outlet to forceably drive water contained in said outlet through the trap under the increasing pressure of the inflated inflatable member; and deflating the inflatable member for removal from the outlet.

One embodiment of the present disclosure relates to a kit comprising the apparatus as defined in the present application, and instructions for use of the apparatus for removing trap water from a plumbing device. In another embodiment, the kit can comprise parts of the apparatus defined in the present application (for example, housing, parts of plunger assembly, and hose member and related connection members) along with instructions for assembling the parts to form an apparatus for removing trap water from a plumbing device, and/or instructions for using the assembled apparatus.

Conveniently, by making use of the tool according to the present disclosure, no unsanitary water is spilled in baths, showers or floors. In the case of a toilet appliance, the water removal keeps the toilet lighter and dry thus facilitating expedited removal of the fixture.

A plunger, which is extensively presented in the prior art noted above is not effective to remove the water and does not mitigate the unsanitary aspects mentioned above.

Referring now to the drawings as they generally describe the disclosure, reference will now be made to the accompanying drawings illustrating preferred embodiments.

Referring now to FIG. 1, shown is an example of the structure according to a first embodiment with the overall device being denoted by numeral 10. The device 10 includes a housing/pump body 12 defining a reservoir therein (not shown), within which is movably mounted a plunger assembly 14 having a rod 16, top end cap 18, handle 20 and a plunger member comprising washers 22 and 24 on either side of a piston seal assembly 26, 28. Fastener 30 connects elements 16, 22, 24, 26 and 28 to rod 16. Housing 12 includes an end cap 32 having an aperture 33 for air ingress and egress and a threaded segment to receive a connector 34. The connector 34 accepts ancillary attachments, one of which is shown in the example as suction hose 36. In one embodiment the suction hose can be connected detachably to the housing.

Figure 2:
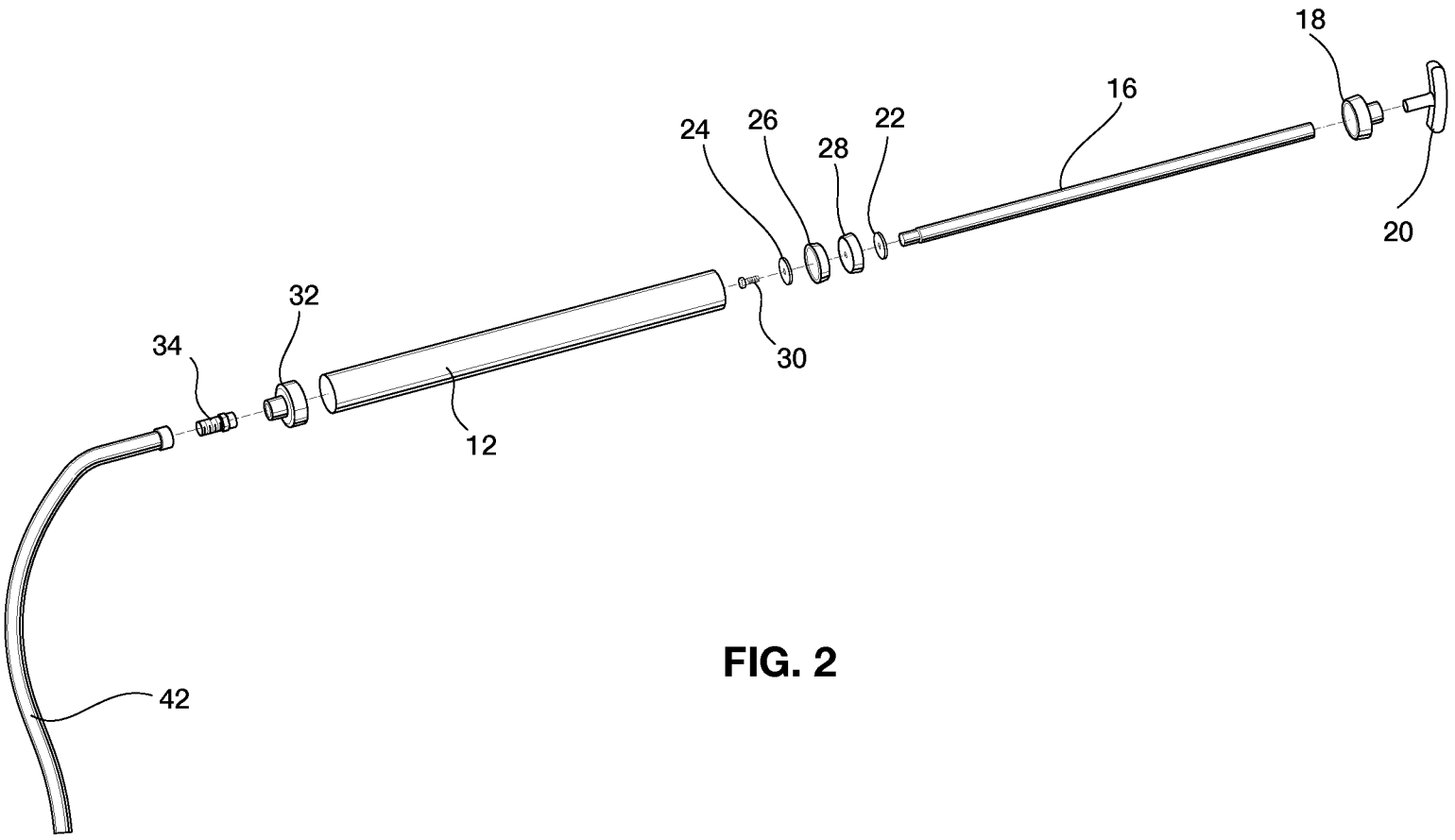
FIG. 2 is an exploded view of another embodiment of the present disclosure.
Figure 3B:
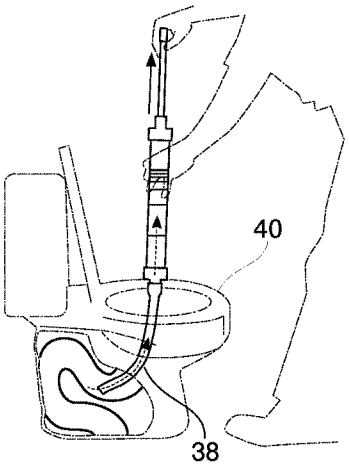
FIGS. 3*a*-3*d* is a schematic view of one embodiment of the present disclosure in use.
Figure 3A:
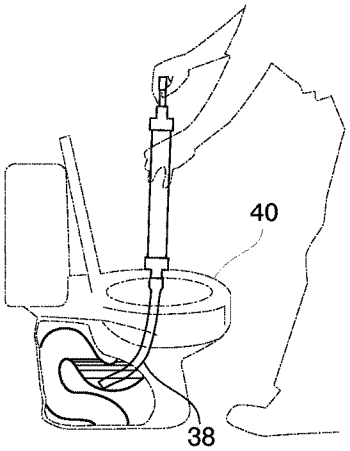
Figure 3D:
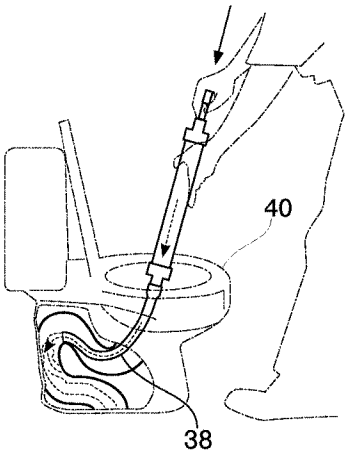
Figure 3C:
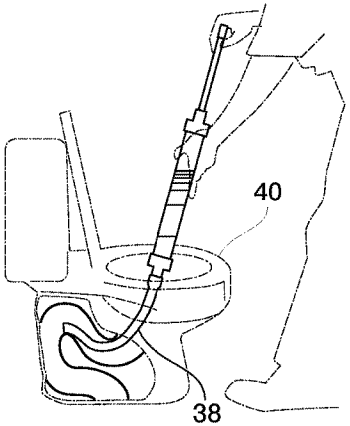

FIG. 2 illustrates another embodiment of the disclosure, wherein an elongate hose 42 is incorporated. In this embodiment, the longer hose 42 can accommodate a larger volume of water which can be retained therein to drain the trap 38 entirely and subsequently discharged into a secondary location. The secondary location may be down the drain of a sink (not shown) or the hose 42 charged with the trap water can be moved forward beyond the trap and the water discharged down the drain. When in use, the suction hose 36 or 42, can be inserted into the trap 38 of plumbing device/appliance 40, shown in FIGS. 3*a*-3*d* as toilet bowl, and any water in the trap 40 can be drawn into the hose 36/42 and/or to the reservoir of the housing 12 by activation of the plunger assembly 14. Once in the hose 36 and/or the reservoir of the housing 12, the water can then be used as a propellant to force any remaining water down the backside of the trap 38 and thus out of the appliance 40.

In one embodiment, the hose is pliable and/or flexible, and/or is pre-bent at one or more predetermined angles to facilitate maneuvering of the hose to a proper location while removing water from the drain trap and/or drain.

Figure 4:
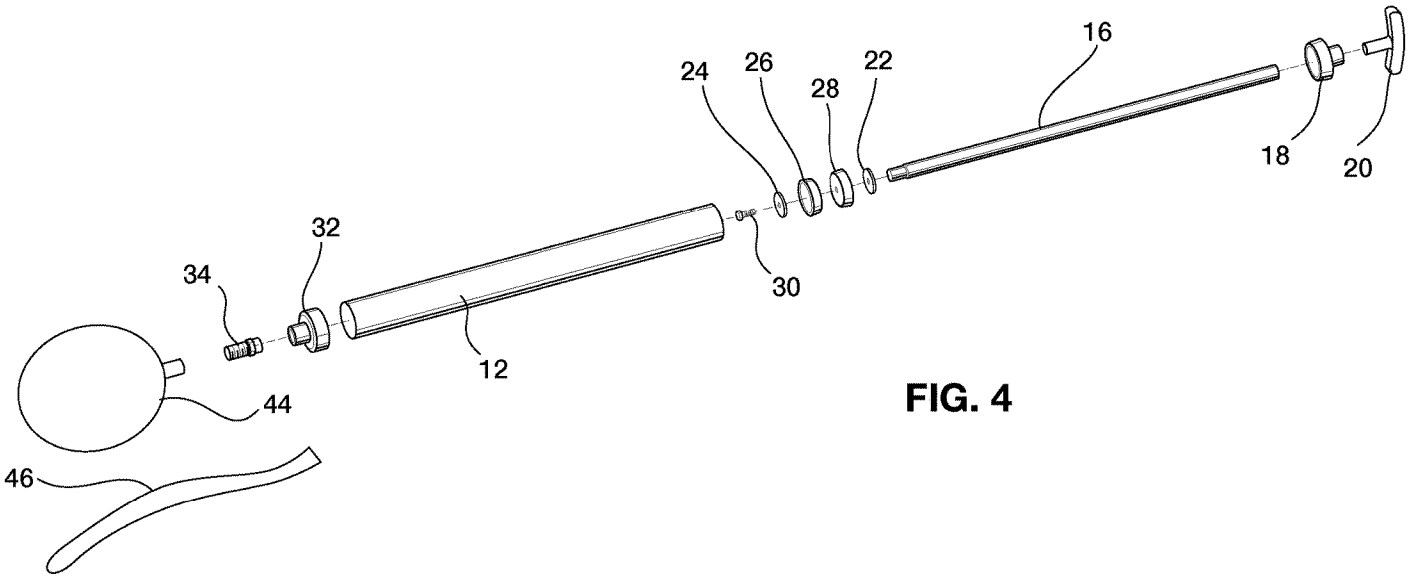
FIG. 4 is a schematic view of another embodiment of the present disclosure.
Figure 7:
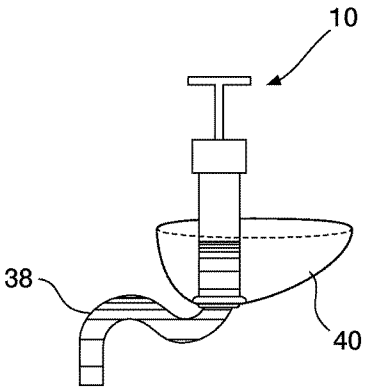
FIG. 7 is a schematic view of another embodiment of the device of the present disclosure in use in a sink.

FIG. 4 illustrates another embodiment in which an inflatable member 44 comprising a generally spherical balloon is attached to the device 10. Alternatively, the inflatable member may also take the form of an elongate configuration denoted by numeral 46. In these embodiments, the member 44 or 46 may be positioned within the drain 38 and inflated (shown in FIG. 7) by pumping the device 10. In this manner, the inflated member 44 or 46 forces the water down the trap 38. The apparatus can further have a valve member for releasing pressure from the inflated member for reuse. The valve member can be positioned on the body 12 or adjacent to the body, for example on the cap 32.

Figure 6:
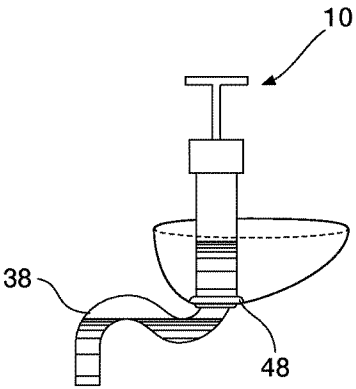
FIG. 6 is a schematic view of another embodiment of the device of the present disclosure in use in a sink.
Figure 5:
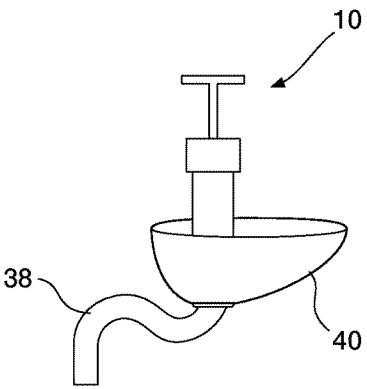
FIG. 5 is a schematic view of another embodiment the device in use in a sink.

FIG. 6 illustrates another embodiment of the disclosure, in which a seal (not shown) is positioned at the end of the housing 12 in place of the hose or the inflatable member. The seal is positioned over the opening 48 of the appliance 40. The plunger 14 can then be actuated forcibly to ensure a blast of air is injected down the trap 38 to clear any water therein. Alternatively, a compressed air cylinder (not shown) may be used as the propellant.

In one embodiment, the seal is located on the end cap 32.

By these embodiments, the trap water from a plumbing device/appliance such as a toilet bowl, sink, etc. may be cleared in a sanitary manner to avoid spillage when the appliance is removed from its normal position for repair or replacement.

The invention claimed is:

1. A method for removing water from a trap of a drain of a plumbing device, comprising the steps of:

a) providing an apparatus for removing water from said trap,
said apparatus comprising:
a housing comprising side walls defining an elongated reservoir, a first opening and a second opening;
a plunger assembly having a plunger member sealingly engaged with sidewalls of the elongate reservoir and movable within the elongate reservoir; and
a pliable and/or flexible hose coupled to the second opening of the housing in fluid communication with the reservoir, and including an open end;

b) positioning the hose open end into the trap of the plumbing device;

c) actuating said plunger assembly to draw water from said trap;

d) temporarily retaining said water within said reservoir prior to disposal of said water in a further portion of the drain downstream of the trap;

e) repositioning the hose open end for fluid communication with the further portion of the drain downstream of the drain trap; and f) actuating said plunger assembly to expel said water from said reservoir through the hose open end downstream of the trap and out of the plumbing device.

2. The method of claim 1 further comprising the step of:

a) repeating steps b) through f) until the trap has been drained.

3. The method of claim 2 further comprising the step of:

a) removing, replacing, or repairing the plumbing device.

4. The method of claim 1 further comprising the steps of:

a) repositioning the hose open end into the trap of the plumbing device; and b) actuating the plunger assembly to expel water, using the water as a propellant to force any water remaining in the trap to move downstream of the trap and out of the plumbing device.

5. A method for removing water from the trap of a plumbing device, comprising the steps of:

a) providing an apparatus comprising a housing defining an elongated reservoir, a rod-and-piston assembly having a piston member sealingly engaged with sidewalls of the elongate reservoir and movable within the elongate reservoir, and a pliable and/or flexible hose coupled to and in fluid communication with the reservoir, the hose including an open end;

b) positioning the hose open end into the trap of the plumbing device, the trap forming part of an open drain of the plumbing device;

c) actuating the rod-and-piston assembly to draw water from said trap into the reservoir;

d) temporarily retaining said water within the reservoir prior to disposal of said water;

e) repositioning the hose open end for fluid communication with a further portion of the open drain downstream of the trap; and f) actuating the rod-and-piston assembly to expel said water from the reservoir through the hose open end into the further portion of the open drain downstream of the trap and out of the device, disposing of said water.

6. The method of claim 5 further comprising the step of:

g) repeating steps b) through f) until the trap has been drained.

7. The method of claim 6 further comprising the step of removing the device.

8. A method for removing water from a trap of an unclogged plumbing device, comprising the steps of:

a) providing an apparatus for removing water from said trap, said apparatus comprising:
a housing comprising side walls defining an elongated reservoir, a first opening and a second opening;
a plunger assembly comprising a rod and piston sealingly engaged with sidewalls of the elongate reservoir and movable within the elongate reservoir; and
a pliable and/or flexible hose coupled to the second opening of the housing in fluid communication with the reservoir, and including an open end;

b) positioning the hose open end into the trap of the unclogged plumbing device;

c) actuating said plunger member to draw water from said trap;

d) temporarily retaining said water within said reservoir prior to disposal of said water in a further portion of a drain downstream of the trap;

e) repositioning the hose open end for fluid communication with the further portion of the drain downstream of the trap; and f) actuating said plunger assembly to expel said water from said reservoir through the hose open end downstream of the trap and out of the unclogged plumbing device.

9. The method of claim 8 further comprising the step of:

g) repeating steps b) through f) until the trap has been drained.

10. The method of claim 9 further comprising the step of removing the device.

* * * * *